US008736174B2

(12) United States Patent
Urdahl et al.

(10) Patent No.: US 8,736,174 B2
(45) Date of Patent: May 27, 2014

(54) PLASMA GENERATION DEVICE WITH SPLIT-RING RESONATOR AND ELECTRODE EXTENSIONS

(75) Inventors: Randall Urdahl, Mountain View, CA (US); James Edward Cooley, San Francisco, CA (US); Gregory S. Lee, Mountain View, CA (US); August Jon Hidalgo, San Francisco, CA (US); Martin L. Guth, Colorado Springs, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 891 days.

(21) Appl. No.: 12/688,082

(22) Filed: Jan. 15, 2010

(65) Prior Publication Data

US 2011/0175531 A1 Jul. 21, 2011

(51) Int. Cl.
*H05H 1/30* (2006.01)

(52) U.S. Cl.
USPC ..... 315/111.21; 315/248; 333/219

(58) Field of Classification Search
USPC ..... 315/39, 248, 344, 111.21, 111.81, 315/111.51; 333/219
See application file for complete search history.

(56) References Cited

U.S. PATENT DOCUMENTS

| | | | | |
|---|---|---|---|---|
| 3,541,372 | A | 11/1970 | Omura et al. | |
| 5,055,809 | A * | 10/1991 | Sagawa et al. | 333/219 |
| 6,917,165 | B2 | 7/2005 | Hopwood et al. | |
| 2001/0035720 | A1 * | 11/2001 | Guthrie et al. | 315/39 |
| 2004/0056738 | A1 * | 3/2004 | Aiga et al. | 333/204 |
| 2005/0067976 | A1 * | 3/2005 | Longo | 315/248 |
| 2007/0170371 | A1 | 7/2007 | Dutton et al. | |
| 2007/0170995 | A1 | 7/2007 | Dutton et al. | |
| 2007/0170996 | A1 | 7/2007 | Dutton et al. | |
| 2009/0121127 | A1 | 5/2009 | Orlando et al. | |
| 2009/0121638 | A1 | 5/2009 | Price et al. | |
| 2010/0019677 | A1 | 1/2010 | Kitano et al. | |
| 2010/0032559 | A1 | 2/2010 | Lopez-Avila et al. | |
| 2010/0327155 | A1 | 12/2010 | Lopez-Avila et al. | |
| 2011/0109226 | A1 | 5/2011 | Cooley et al. | |

* cited by examiner

*Primary Examiner* — Benny Lee

(57) ABSTRACT

A plasma generation device includes: a substrate having a first surface and a second surface; a stripline resonant ring disposed on the first surface of the substrate, and defining a discharge gap; a pair of electrode extensions connected to the stripline resonant ring at the discharge gap; a ground plane disposed on the second surface of the substrate; a gas flow element configured to flow gas between at least one of: (1) the discharge gap, and (2) the pair of electrode extensions; and a structure disposed adjacent the substrate to form an enclosure that substantially encloses at least a region including the discharge gap and the electrode extensions, the enclosure being adapted to contain a plasma.

20 Claims, 15 Drawing Sheets

500

1000

PLASMA GENERATION DEVICE WITH SPLIT-RING RESONATOR AND ELECTRODE EXTENSIONS

BACKGROUND

A plasma is a gaseous collection of ions, neutral atoms or molecules, and free electrons. Plasmas are electrically conductive because the unbound charged particles couple easily to electromagnetic fields. While the definition of the term "plasma" can vary, it usually includes some element of "collective" behavior, meaning that any one charged particle can interact with a large number of other charged particles in the plasma.

There are a number of applications which require miniaturized plasma sources. These applications include bio-sterilization, small scale materials processing and microchemical analysis systems.

Hopwood et al., U.S. Pat. No. 6,917,165, describes the use of a microstrip resonator at microwave frequencies for producing "non-thermal" plasmas at a gap in the same plane as the resonator. FIG. 1 illustrates a device 100 disclosed by of Hopwood. Device 100 includes a substrate 10 of dielectric material, a stripline 12 provided on substrate 10 and connected at one end to a coaxial connector 14 and at the other end to a high Q split-ring resonator (hereinafter "resonant ring") 16 having a discharge gap 18 in the plane of substrate 10. A ground plane 20 is provided on the opposite side of the substrate 10 from resonant ring 16.

Stripline 12 is one-quarter wavelength ($\lambda/4$) in length at the operating frequency and serves as a quarter wave transformer to match the impedance of resonant ring 16 to the impedance of a power supply which energizes the generator. The impedance is typically 50 ohms. The circumference of resonant ring 16 is one-half wavelength ($\lambda/2$) at the operating frequency. The angle between discharge gap 18 and the centerline of resonant ring 16 is such that the impedance measured at the power input at connector 14 is matched to that of the power supply. Voltages at the ends of resonant ring 16 on either side of discharge gap 18 are 180 degrees out of phase with each other.

The electric field at discharge gap 18 is further enhanced by the Q of resonant ring 16, where Q is the quality factor of the resonator [$Q=2\pi$(energy stored/energy dissipated)], and the small dimension (in general less than 50 μm) of discharge gap 18. Accordingly, high electric fields are available across discharge gap 18. If a gas-confining structure is provided at an area spanning discharge gap 18, the high voltage across discharge gap 18 can strike the gas to form a microplasma discharge.

FIG. 2 illustrates another device 200 disclosed by Hopwood. Device 200 includes a high Q split-ring resonator (hereinafter "resonant ring") 40 with a discharge gap 42 between confronting ends of the stripline, and an input connector 41 on the stripline, disposed on a first surface of a substrate 46. A ground plane (not shown) is provided on the opposite side of substrate 46. Discharge gap 42 is typically 50 μm. Connector 44 and discharge gap 42 are in positions on resonant ring 40 to provide an impedance matched to that of the power supply, typically 50 ohms. Compared to device 100, the $\lambda/4$ transmission line is eliminated and impedance matching of resonant ring 40 is accomplished by the dimensions of resonant ring 40 and the position of input connector 44 and discharge gap 42 on resonant ring 40.

Dutton et al., U.S. Patent Application Publication 2007/0170995, describes a plasma generator with a split-ring resonator and a gas flow element configured to flow gas through a discharge gap in the split-ring resonator. U.S. Patent Application Publication 2007/0170995 is incorporated herein by reference for all purposes as if fully set forth herein.

FIG. 3 illustrates a split-ring resonator device 300 disclosed by Dutton. The left hand side of FIG. 3 shows a top view of device 300, and the right hand side of FIG. 3 shows a cross-sectional view through line I-I' in the top view of device 300. Device 300 includes a planar substrate 310 (planar in the X/Y plane) of dielectric material, a stripline transmission line 312 provided on a first ("top") surface of substrate 310 and having a first end 314 and an opposite second end connected to a split-ring resonator (hereinafter "resonant ring") 316 having a discharge gap 318. A ground plane 320 is provided on a second ("bottom") side of substrate 310 opposite from the first side that includes resonant ring 316. Device 300 includes a gas flow element 328 configured in operation (e.g., during plasma generation) to flow a stream of gas through discharge gap 318. In the embodiment shown in FIG. 3, the gas flow element 328 extends through substrate 310 and is configured to flow gas substantially orthogonally to the X/Y plane (i.e., substantially in the Z direction).

FIG. 4 shows a plasma generation device 400 disclosed by Dutton which includes split-ring resonator device 300, an RF/microwave connector 440, a power source 460, a gas supply 470, and a gas feed connector 472. The left hand side of FIG. 4 shows a top view of plasma generation device 400, and the right hand side of FIG. 4 shows a cross-sectional view through line I-I' in the top view of plasma generation device 400. In operation, plasma generation device 400 may produce a plasma jet 50 that emanates from gas flow element 328.

Although the devices described above can usefully generate plasma, there is a continuing interest in developing devices which can operate more efficiently, generate greater plasma densities, or are just generally better suited for particular applications.

SUMMARY

Aspects of the invention include plasma generation devices and systems, as well as methods of generating and using plasma.

In an example embodiment, a device comprises: a substrate having a first surface and a second surface; a stripline resonant ring disposed on the first surface of the substrate, and defining a discharge gap; a ground plane disposed on the second surface of the substrate; a pair of electrode extensions connected to the stripline resonant ring at the discharge gap; a gas flow element configured to flow gas between at least one of: (1) the discharge gap, and (2) the pair of electrode extensions; and an enclosure structure disposed adjacent the substrate to form an enclosure that substantially encloses at least a region including the discharge gap and the electrode extensions, the enclosure being adapted to contain a plasma.

In another example embodiment, a system comprises a plasma generation device, and a power source and a gas feed line each coupled to the plasma generation device. The plasma generation device comprises: (i) a substrate having a first surface and a second surface; (ii) a stripline resonant ring disposed on the first surface of the substrate and defining a discharge gap; (iii) a pair of electrode extensions connected to the stripline resonant ring at the discharge gap; (iv) a ground plane disposed on the second surface of the substrate; (v) a connector coupled to the resonator for connecting the power source to the resonator; (vi) a gas flow element configured to flow gas between at least one of: (1) the discharge gap, and (2) the pair of electrode extensions; and (vii) a structure disposed adjacent the substrate to form an enclosure that substantially encloses at least a region including the discharge gap and the electrode extensions, the enclosure being adapted to contain a plasma.

In yet another example embodiment, a method includes (a) providing a gas to a plasma generation device; (b) flowing the gas between at least one of: (1) a discharge gap, and (2) a pair of electrode extensions of the plasma generation device; (c) causing an electric discharge at least at one of the discharge gap and electrode extensions sufficient to strike a plasma from the flowing gas; and (d) producing a light which exits a windowless exit orifice in a structure of the plasma generation device. The plasma generation device comprises: (i) a substrate having a first surface and a second surface; (ii) a stripline resonant ring disposed on the first surface of the substrate, and defining the discharge gap; (iii) a pair of electrode extensions connected to the stripline resonant ring at the discharge gap; (iv) a ground plane disposed on the second surface of the substrate; a pair of electrode extensions connected to the stripline resonant ring at the discharge gap; (v) a gas flow element configured to flow gas between at least one of: (1) the discharge gap, and (2) the pair of electrode extensions; and (vi) a structure disposed adjacent the substrate to form an enclosure that substantially encloses at least a region including the discharge gap and the electrode extensions, the enclosure being adapted to contain a plasma and having an orifice through which the light passes to an exterior of the enclosure;

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. As used herein, "approximately" means within 10%, and "substantially" means at least 75%. As used herein, when a first structure, material, or layer is said to cover a second structure, material, or layer, this includes cases where the first structure, material, or layer substantially or completely encases or surrounds the second structure, material or layer.

Figure 1:
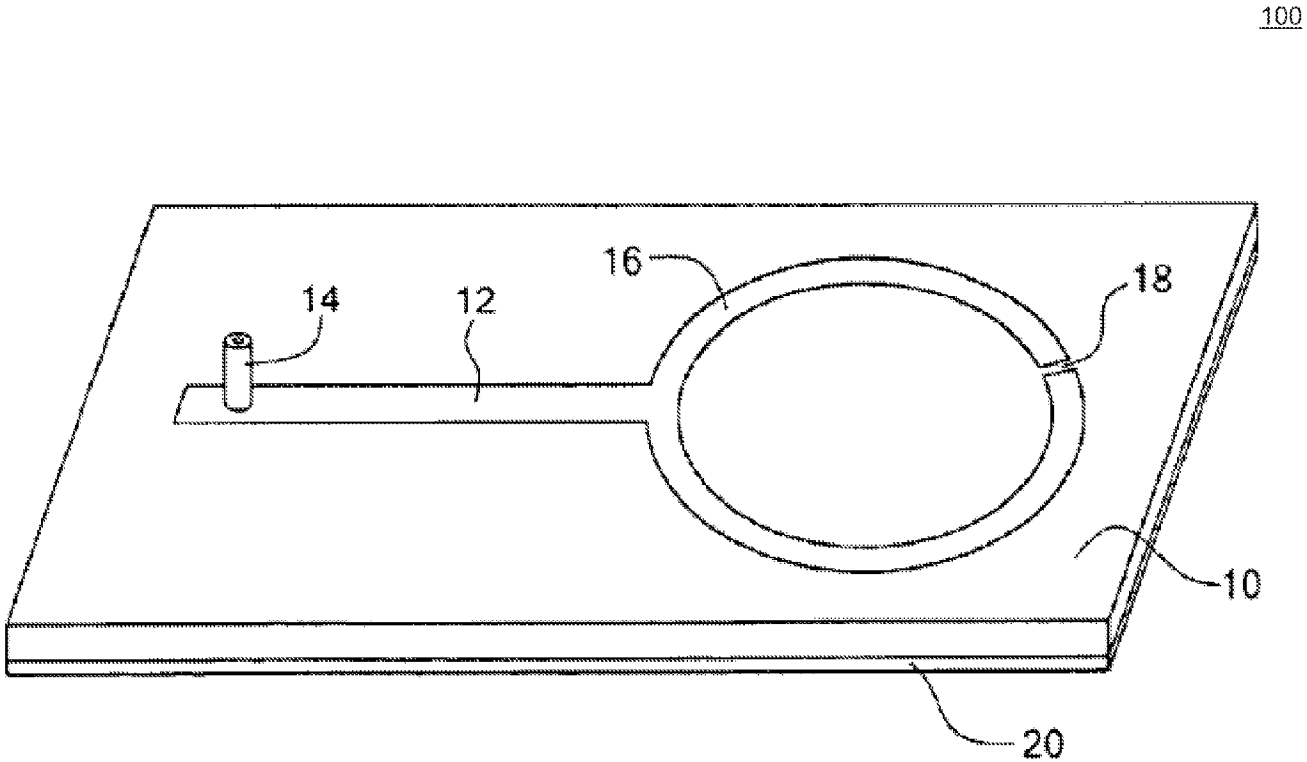
FIG. 1 Prior Art
FIG. 1 illustrates a known split-ring resonator device.
Figure 2:
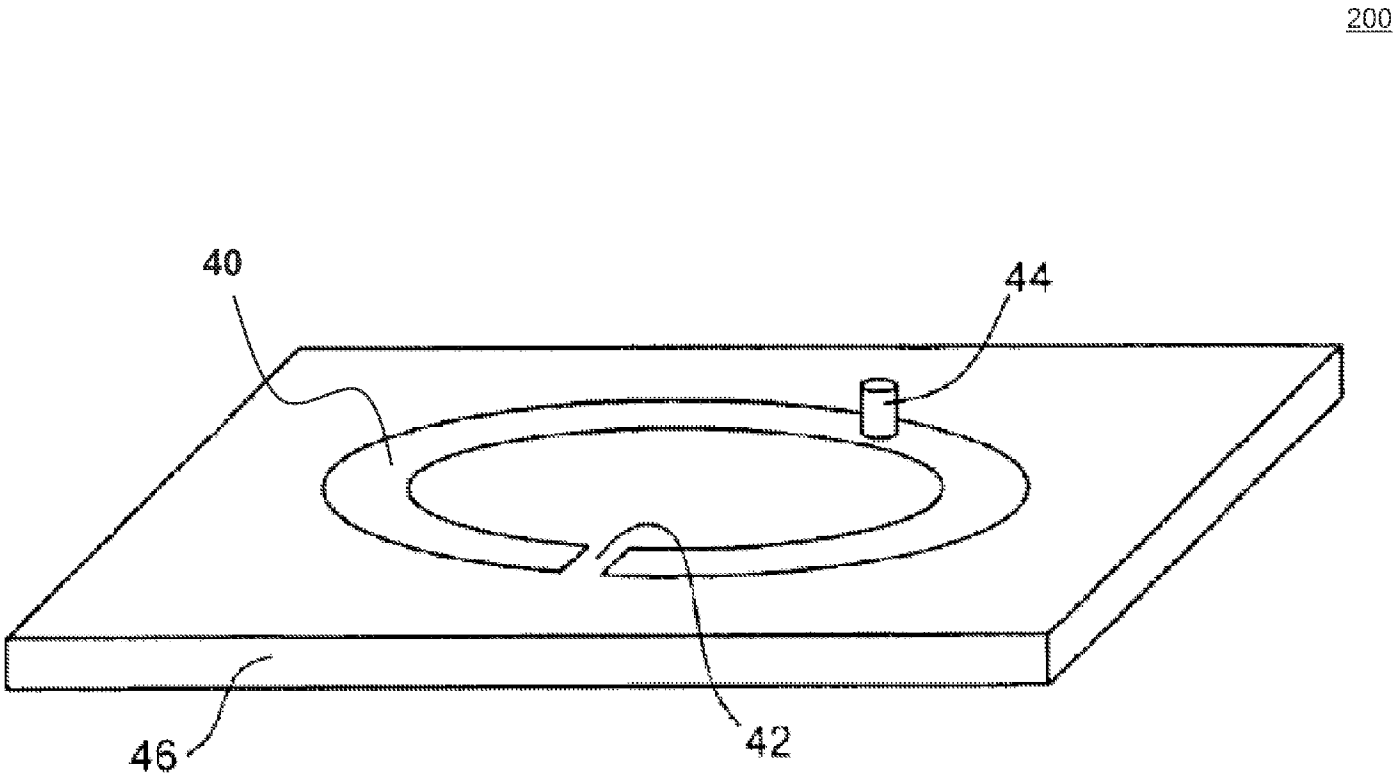
FIG. 2 Prior Art
FIG. 2 illustrates another known split-ring resonator device.
Figure 3:
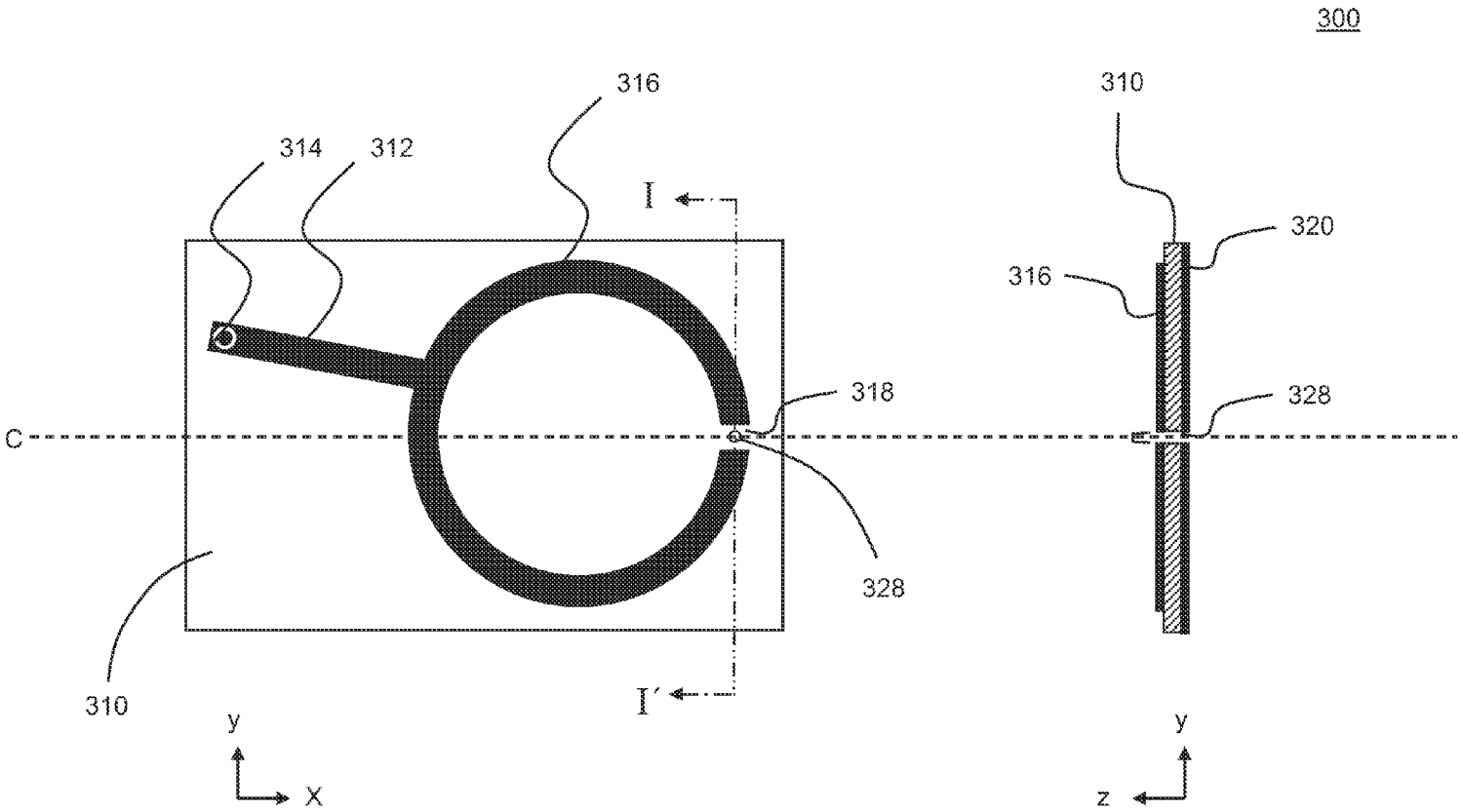
FIG. 3 Prior Art
FIG. 3 illustrates yet another known split-ring resonator device.
Figure 4:
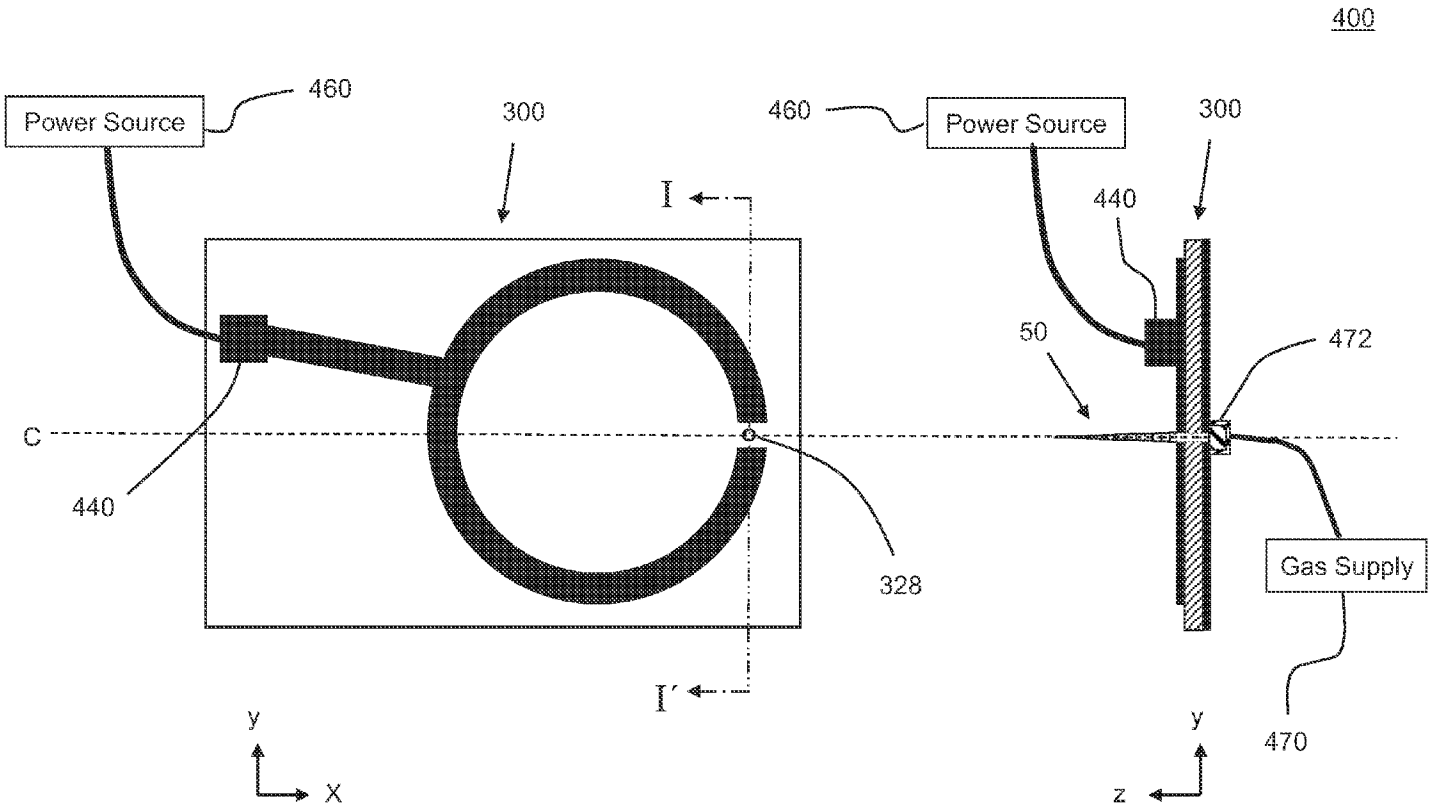
FIG. 4 Prior Art
FIG. 4 illustrates a known plasma generation device including the split-ring resonator device of FIG. 3.
Figure 5:
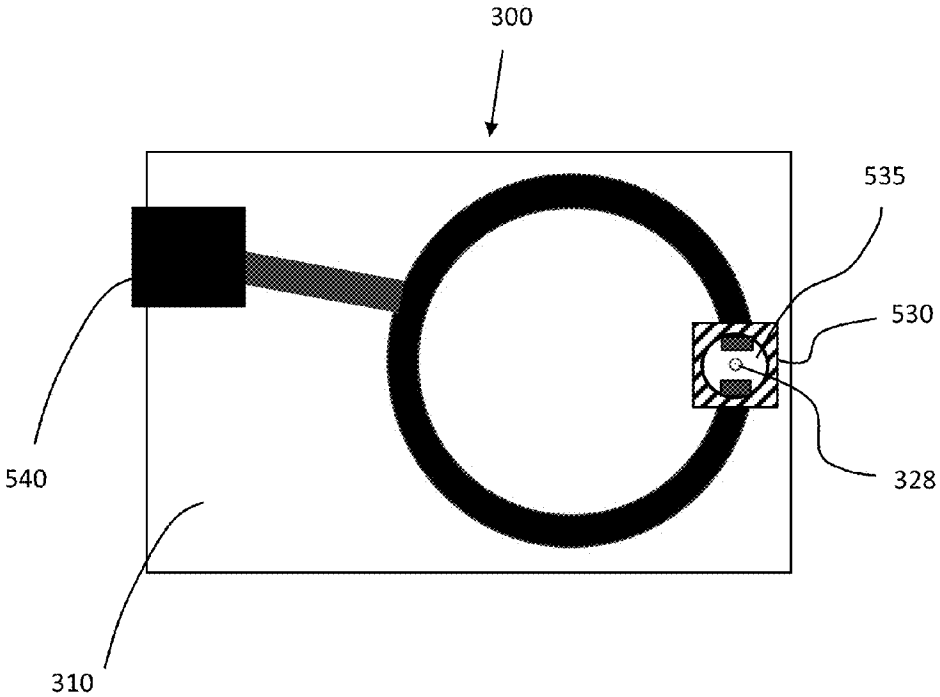
FIG. 5 illustrates a cutaway view of a portion of a plasma generation device.

FIG. 5 illustrates a cutaway view of a portion 500 of a plasma generation device. The plasma generation device includes split-ring resonator device 300, an RF/microwave connector 540, and a lower element 530 of a plasma containment structure. Lower element 530 is disposed adjacent substrate 310 and has an aperture therein for forming a cavity 535 in an enclosure which will be discussed in more detail below.

Figure 6:
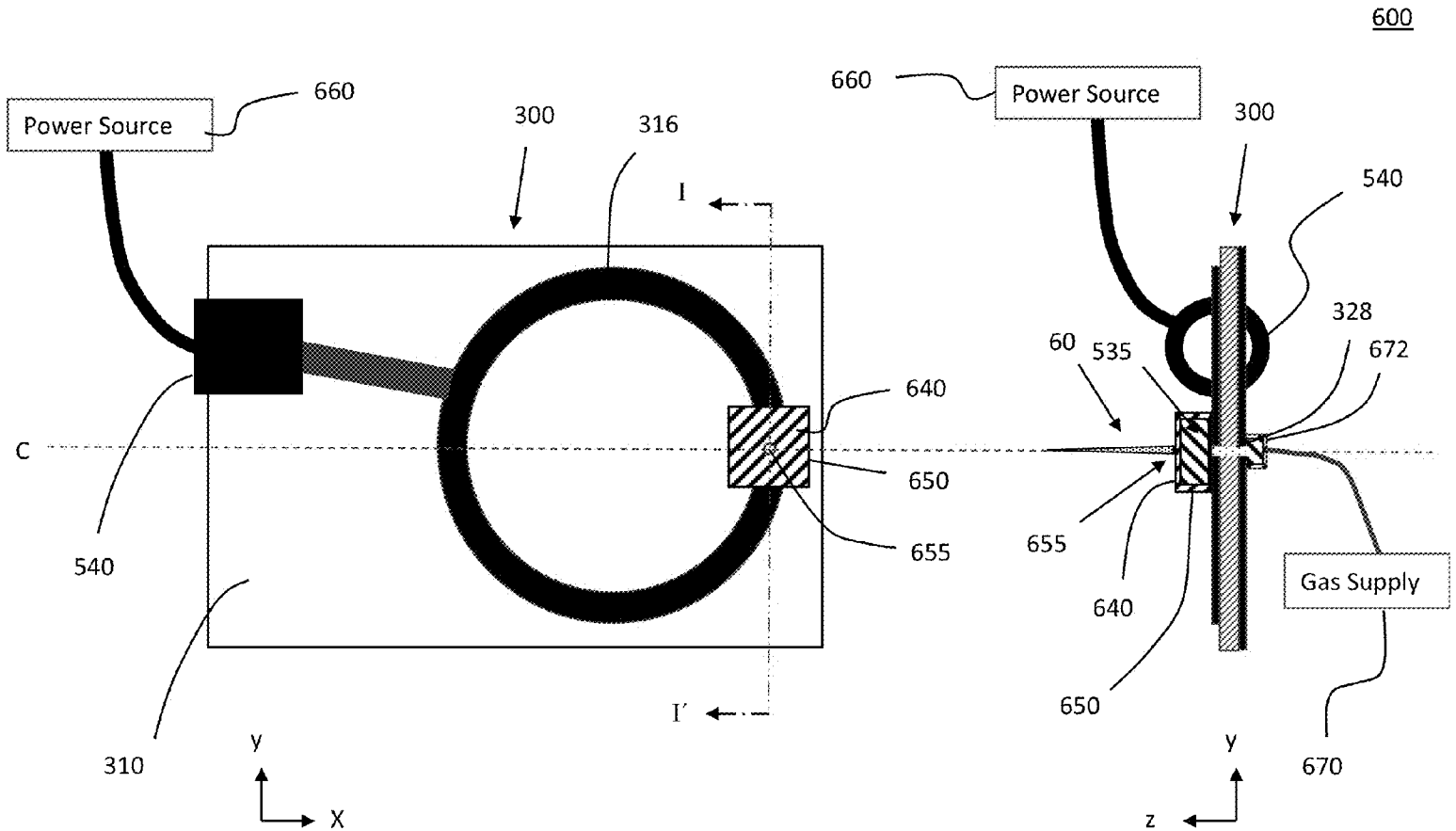
FIG. 6 illustrates a plasma generation device with a plasma containment structure.

FIG. 6 illustrates a plasma generation device 600. The left hand side of FIG. 6 shows a top view of plasma generation device 600, and the right hand side of FIG. 6 shows a cross-sectional view through line I-I' in the top view of plasma generation device 600. Plasma generation device 600 includes split-ring resonator device 300, an RF/microwave connector 540, plasma containment structure 650, RF/microwave source 660, gas supply 670, and a gas feed connector 672. Plasma containment structure 650 includes lower element 530 (not shown in FIG. 6) and an upper element 640 and, together with the first surface of substrate 310, forms an enclosure which defines cavity 535 which in operation contains plasma therein. Upper element 640 of plasma containment structure 650 includes an orifice 655 extending in a direction perpendicular to the plane of the first surface of substrate 310.

In operation, gas from gas supply 670 flows through gas flow element 328 in discharge gap 318 (not shown in FIG. 6). An RF/Microwave signal is provided from RF/microwave source 660 to resonant ring 316 which produces a strong electric field across discharge gap 318 and strikes the flowing gas to produce a plasma which fills cavity 535. The plasma generates a light beam 60 which exits from orifice 655 in a direction perpendicular to the plane of the first surface of substrate 310.

Figure 7:
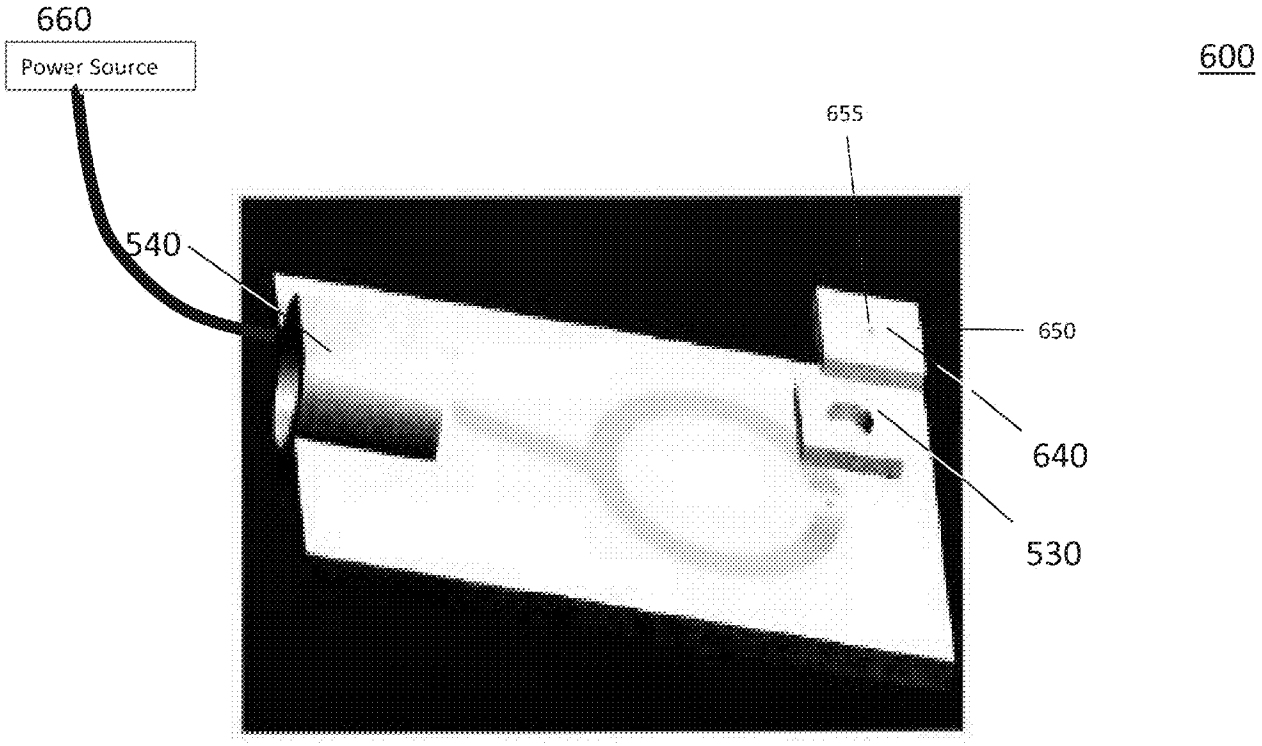
FIG. 7 shows an exploded view of the plasma generation device of FIG. 6.

FIG. 7 shows an exploded view of plasma generation device 600.

Plasma generation device 600 is able to generate microplasma in plasma containment structure 650 and provide a supply of vacuum ultraviolet (VUV) photons from orifice 655. However, the inventors have discovered that the optical output of plasma generation device 600 is limited by a plasma saturation effect. Namely, as more RF/microwave power is applied from RF/microwave source 660, VUV output saturates or decreases.

Figure 8:
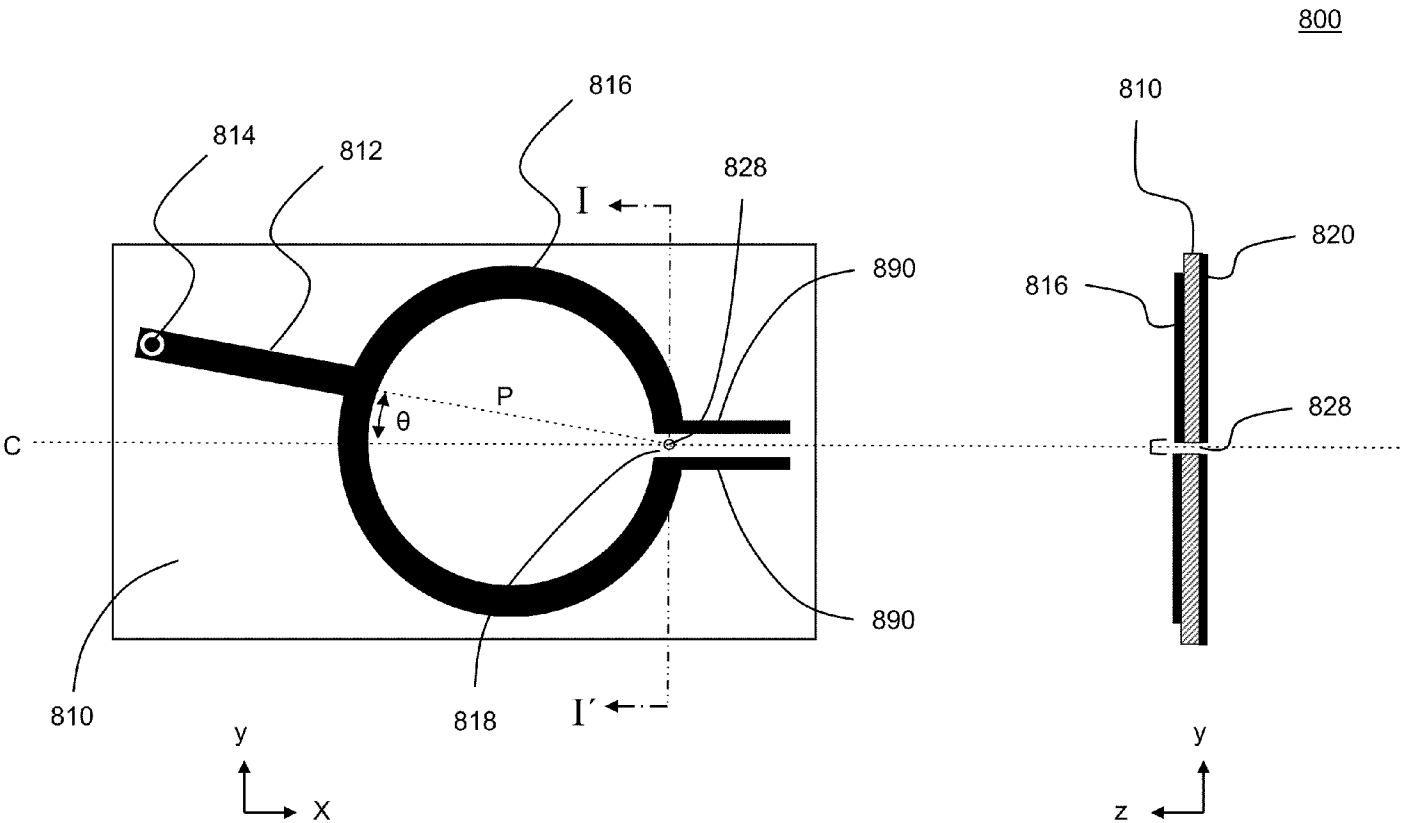
FIG. 8 illustrates one embodiment of a split-ring resonator device including electrode extensions.

FIG. 8 illustrates one embodiment of a split-ring resonator device 800 including electrode extensions 890. The left hand side of FIG. 8 shows a top view of split-ring resonator device 800, and the right hand side of FIG. 8 shows a cross-sectional view through line I-I' in the top view of split-ring resonator device 800. Split-ring resonator device 800 includes a planar substrate 810 (planar in the X/Y plane, hereinafter referred to as "substrate 810") of dielectric material, a stripline transmission line 812 provided on a first (top) surface of substrate 810 having a first end 814 and at a second end that is connected to a split-ring resonator (hereinafter "resonant ring") 816 having a discharge gap 818. A ground plane 820 is provided on a second (bottom) side of substrate 810, opposite the first side with the microstrip resonant ring 816.

Beneficially, split-ring resonator device 800 includes a pair of electrode extensions 890 connected to microstrip resonant ring 816 at discharge gap 818, whose benefits will be discussed in greater detail below.

Split-ring resonator device 800 includes a gas flow element 828 that is configured in operation (e.g., during plasma generation) to flow a stream of gas between discharge gap 818 and/or the pair of electrode extensions 890.

Figure 9:
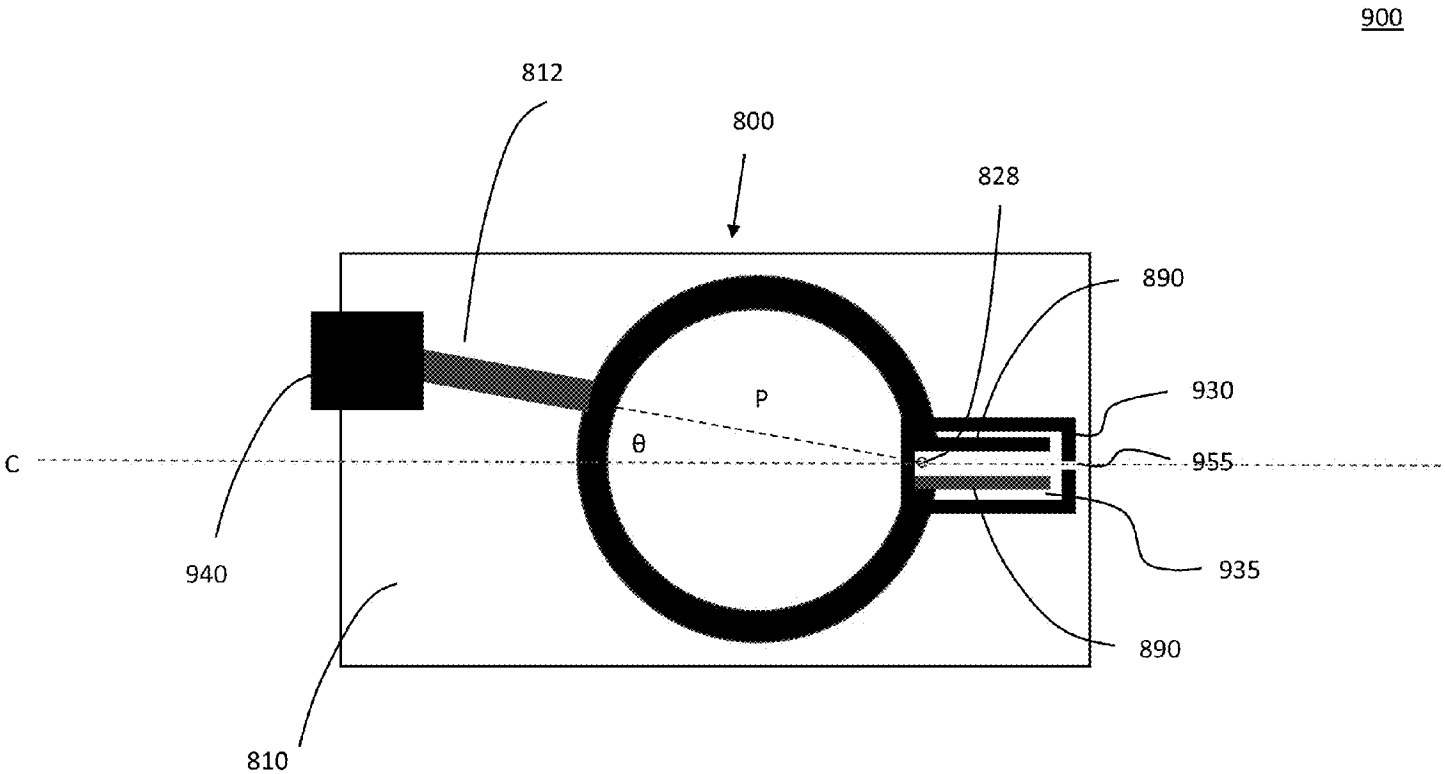
FIG. 9 illustrates a cutaway view of one embodiment of a portion of the plasma generation device of FIG. 10.

FIG. 9 illustrates a cutaway view of one embodiment of a portion 900 of a plasma generation device. The plasma generation device includes split-ring resonator device 800, an RF/microwave connector 940, and a lower element 930 of a plasma containment structure. Lower element 930 is disposed adjacent substrate 810 and has an aperture therein for forming a cavity 935 in a plasma containment enclosure will be discussed in more detail below.

Figure 10:
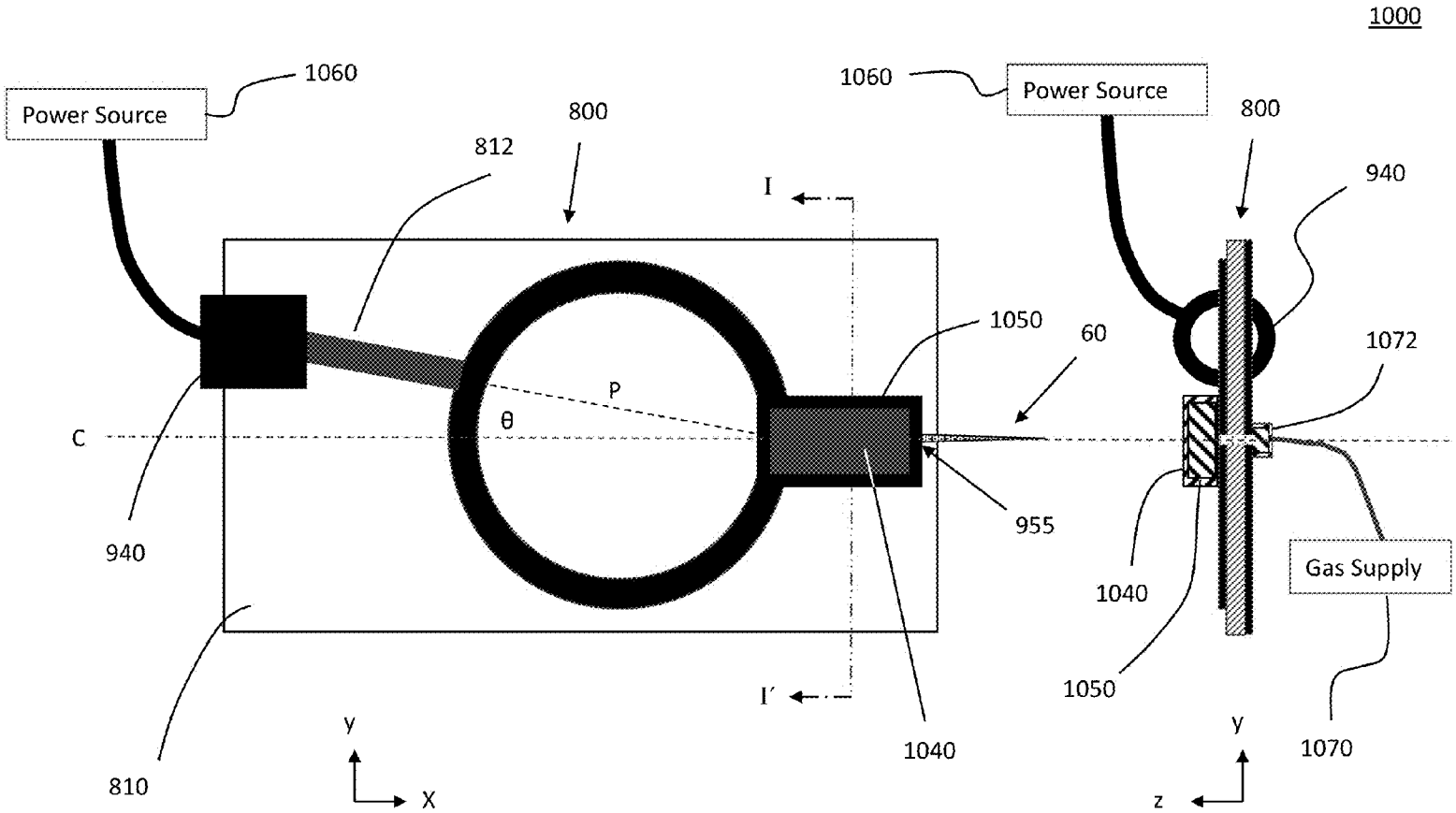
FIG. 10 illustrates one embodiment of a plasma generation device including the split-ring resonator device of FIG. 8.

FIG. 10 illustrates one embodiment of a plasma generation device 1000 that includes the split-ring resonator device 800 of FIG. 8. The left hand side of FIG. 10 shows a top view of plasma generation device 1000, and the right hand side of FIG. 10 shows a cross-sectional view through line I-I' in the top view of plasma generation device 1000. Plasma generation device 1000 includes split-ring resonator device 800, RF/microwave connector 940, plasma containment structure 1050, RF/microwave power source 1060, gas supply 1070, and a gas feed connector 1072.

Figure 11:
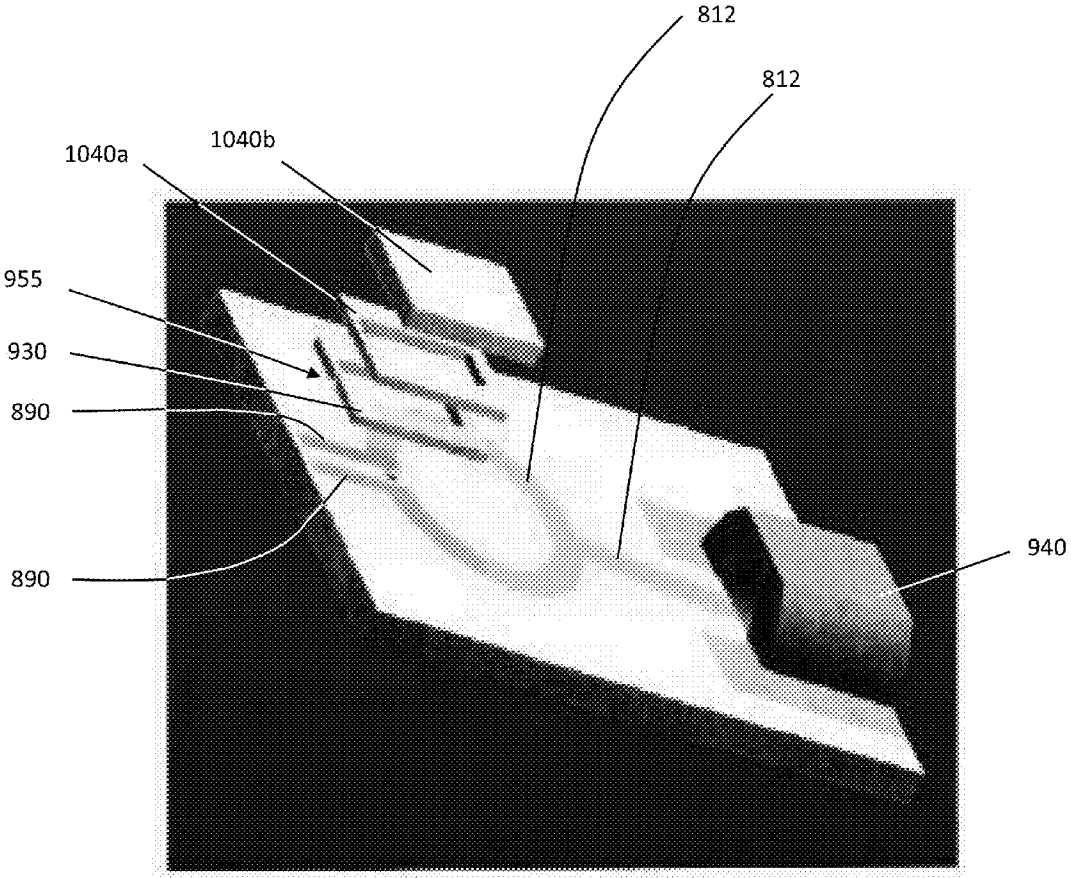
FIG. 11 shows an exploded view of the plasma generation device of FIG. 10.

FIG. 11 shows an exploded view of the plasma generation device 1000 of FIG. 10.

In certain embodiments, RF/microwave connector 940 (with or without stripline transmission line 812) and discharge gap 818, are disposed in positions on microstrip resonant ring 816 such that, together with electrode extensions 890, they provide an impedance matched to that of RF/microwave power source 1060. By "matched" is meant that the impedance that is presented at RF/microwave connector 940 is equivalent to the output impedance of a power source such that maximum power transfer can be obtained. Any difference in these two impedances can result in a reflected component of power at RF/microwave connector 940 back towards RF/microwave power source 1060 (not shown in FIG. 11). In certain embodiments, the circumference of microstrip resonant ring 816 is one-half wavelength ($\lambda/2$) at the operating frequency of plasma generation device 1000. The angle ($\theta$) between the centerline of microstrip resonant ring 816 (dashed line "C" in FIGS. 8-10) and the line connecting RF/microwave connector 940 and discharge gap 818 (dashed line "P" in FIGS. 8-10) is such that the impedance measured at the power input at RF/microwave connector 940 is matched to that of RF/microwave power source 1060. When power is applied to microstrip resonant ring 816, a maximum voltage difference occurs across discharge gap 818. In certain embodiments, the magnitude of this maximum voltage difference ranges from about 50V to about 750V, such as from about 75V to about 600V and including from about 120V (0.5 W, 50 ohm, Q=110) to about 475V (8 W, 50 ohm Q=110). Thus, the electric field is concentrated in discharge gap 818 and, in certain embodiments, is at least double the magnitude of the electric field between microstrip resonant ring 816 and ground plane 820. The dimensions of microstrip resonant ring 816, electrode extensions 890, and discharge gap 818 are determined in the design of specific embodiments to achieve the intended resonant frequency and performance characteristics of plasma generation device 1000.

Discharge gap 818 can have a variety of dimensions and configurations so long as it is configured to provide for striking of plasma under conditions of use. In certain embodiments, discharge gap 818 is over the surface of substrate 810 whereas in other embodiments, discharge gap 818 extends into or through substrate 810. Discharge gap 818 can vary in size, where the dimensions of discharge gap 818 are selected to provide for plasma striking of a gas flowing through discharge gap 818 under intended parameters of use. In certain embodiments, discharge gap 818 has a width (i.e., the distance between ends of microstrip resonant ring 816) that ranges from about 20 μm to about 1.2 mm, such as from about 50 μm to about 1.0 μm and including from about 400 μm to about 800 μm.

In certain embodiments of split-ring resonator device 800, substrate 810 is a dielectric material that has a high dielectric constant. By high dielectric constant is meant a dielectric constant that is 2 or higher, such as 5 or higher, including 9.6 (e.g., ceramic) or higher. Dielectric materials that find use as substrates 810 include, but are not limited to, ceramic compounds, TEFLON® (Polytetrafluoroethylene (PTFE)), polymers, glass, quartz and combinations thereof. For embodiments that are operated in air, then hard dielectrics with no organic component are required, such as ceramic, glass and quartz. In certain embodiments substrate 810 is fabricated from a single material whereas in certain other embodiments the substrate contains more than one material, e.g., different layers of distinct materials. The dimensions of substrate 810 can vary widely depending on the intended use of the plasma generated by plasma generation device 1000 and/or the nature of the dimensions of microstrip resonant ring 816, which are a function of the substrate dielectric properties, the frequency of operation and the required characteristic impedance. In certain embodiments, substrate 810 is a planar substrate and has a length ranging from about 5 mm to about 100 mm, such as from about 10 mm to about 70 mm and including from about 20 mm (actual ceramic) to about 50 mm (actual RT/DUROID®); a width ranging from about 5 mm to about 100 mm, such as from about 10 mm to about 70 mm and including from about 12 mm (actual ceramic) to about 40 mm (actual RT/DUROID®) and a thickness ranging from about 100 μm to about 5 mm, such as from about 100 μm to about 2 mm and including from about 1 mm (actual ceramic) to about 2 mm.

In certain embodiments of split-ring resonator device 800, ground plane 820 and microstrip resonant ring 816 are disposed on opposing sides of substrate 810 and as such are not in physical contact with each other. The distance between ground plane 820 and microstrip resonant ring 816 may vary, where in certain embodiments the distance between these two components may range from about 100 μm to about 5 mm, such as from about 100 μm to about 2 mm and including from about 1 mm to about 2 mm. In certain embodiments, ground plane 820 and microstrip resonant ring 816 are made of the same material, while in certain other embodiments they are made of different materials. Ground plane 820 and/or microstrip resonant ring 816 can be fabricated from a variety of different materials including, but not limited to, Au, Cu, Ag and the like. The thickness of microstrip resonant ring 816 layer and ground plane 820 layer can vary. In certain embodiments, ground plane 820 has a thickness ranging from about 1 μm to 50 μm, including from about 1 μm to 25 μm, such as from about 2 μm to about 10 μm, and including from about 6 μm to about 6.5 μm. In certain embodiments, microstrip resonant ring 816 has a thickness ranging from about 1 μm to 50 μm, including from about 1 μm to 25 μm, such as from about 2 μm to about 10 μm, and including from about 6 μm to about 6.5 μm. In certain embodiments, the thickness of ground plane 820 and the microstrip layer is the same (or similar) whereas in other embodiments the thicknesses of these two components is different.

Microstrip resonant ring 816, and its discharge gap 818, can take a variety of shapes. Thus, the term "ring" is not to be limited to only a circular ring but is intended to refer to any circular or non-circular shaped structure, where structures of interest include, but are not limited to: circular, elliptical or oval and other non-circular rings, and rectangular or other multisided shapes. Microstrip resonant ring 816 can be disposed on substrate 810 in a variety of ways. In certain embodiments, substrate 810 is coated with material for the microstrip layer (e.g., Au, Cu, etc.) and microstrip resonant ring 816 is formed by photo-lithographic and wet etching techniques which themselves are known in the art. Other processing techniques can be used to form microstrip resonant ring 816 and discharge gap 818.

As indicated above, microstrip resonant ring 816 is coupled to RF/microwave connector 940 for connecting RF/microwave power source 1060 that supplies power to microstrip resonant ring 816 during operation. RF/microwave connector 940 may be any of a variety of known connectors. In certain embodiments, RF/microwave connector 940 is a subminiature push-on (SMP) connector. However, in other embodiments, other types of connectors may be employed, such as a subminiature type A (SMA) coaxial connector attached at right angles to the microstrip resonant ring and used to couple power to the device (e.g., as described. U.S. Pat. No. 6,917,165, the disclosure of which is herein incorporated by reference). Edge mounting connectors can also be used.

In certain embodiments, RF/microwave connector 940 is linked to microstrip resonant ring 816 by an additional stripline transmission line 812. In general, the design of the resonator geometry gives a primary impedance transformation, and no further transformation is required. Hence the length of additional stripline transmission line 812 does not affect the overall impedance of the device. However if the range of impedance transformation is not fully accommodated by the geometry of the resonator, then stripline transmission line 812 can be used to provide a further impedance transformation by having a line width, and hence characteristic impedance, different from that of microstrip resonant ring 816. Lengths and widths of stripline transmission line 812 can be calculated by those skilled in the art.

As indicated above, plasma generation device 1000 contains gas flow element 828 configured to flow a gaseous stream. In the embodiments illustrated in FIGS. 8-10, gas flow element 828 is configured to flow a gaseous stream through or between discharge gap 818. In alternative arrangements, gas flow element 828 may be configured to flow a gaseous stream between discharge gap electrode extensions 890 and/or discharge gap 818. In those embodiments, the location of gas flow element 828 may be changed with respect to that shown in the embodiments illustrated in FIGS. 8-10.

In the embodiments illustrated in FIGS. 8-10, gas flow element 828 extends through substrate 810 and is configured to flow gas substantially orthogonally to the X/Y plane (i.e., substantially in the Z direction (FIGS. 8,10), for example, from the second side of substrate 810 to the first side of substrate 810. The flow of gas delivered by gas flow element 828 can be in a variety of directions relative to discharge gap 818 and/or electrode extensions 890. In certain embodiments the gas flow is such that gas flows from the bottom of discharge gap 818 to the top of discharge gap 818, such that when a plasma is struck from the gas a plasma jet proceeds from the first (top) surface of discharge gap 818. In certain embodiments, gas flow element 828 flows gas in a direction that is substantially orthogonal, and in certain embodiments approximately orthogonal, or actually orthogonal, to discharge gap 818. By "actually orthogonal to discharge gap 818" is meant that the gas flows through discharge gap 818 from a point in the X/Z plane of plasma generating device 100. In other words, the gas flow is at a right angle (90 degrees) (or substantially normal) to a line connecting the center of the discharge gap leads (dashed line I-I'). In some embodiments, gas flow element 828 is a channel drilled (or bored) through substrate 810 and ground plane 820. The width of the channel may vary, and in certain embodiments ranges from about 20 μm to about 1.2 mm, such as from about 50 μm to about 1.0 mm and including from about 400 μm to about 800 μm. In these embodiments, gas flow element 828 provides for a flow of gas in a direction that is substantially orthogonal to substrate 810 (and discharge gap 818).

In other embodiments, a gas flow element may flow gas in a direction that is not orthogonal to substrate 810. In certain of these embodiments, the gas flow delivered by the gas flow element is in substantially the same plane as the first (top) surface of substrate 810 on which microstrip resonant ring 816 is disposed (in the X/Y plane). In certain of these embodiments, the gas flow is substantially orthogonal to line dashed line I-I'.

Gas flow element 828 can be configured in a variety of ways. In certain embodiments, gas flow element 828 is integral to substrate 810. For example, gas flow element 828 may be a hole or aperture that is etched, molded, bored or drilled directly onto/into substrate 810 and/or ground plane 820. In certain other embodiments, gas flow element 828 is a separate element that is capable of conveying a gas from a first location to second location, e.g., gas line, which is stably attached, e.g., affixed, to the structure in a manner sufficient to provide for the desired gas flow through discharge gap 818 during use. Gas flow element 828 may be fabricated from the same material as or a different material than the materials from which the other components of the device are fabricated, e.g., substrate 810.

Plasma generation device 1000 contains a gas feed connector 1072 coupled to gas flow element 828. Gas feed connector 1072 is configured to attach a gas feed line to gas flow element 828, and may include a number of different components, e.g., nozzles, lips, threads, gaskets, etc., made from a variety of different materials, e.g., rubber, silicone, metal solder etc. Gas feed connector 1072 can be disposed in any convenient location on plasma generation device 1000. For example, in the embodiment shown in FIG. 10, gas feed connector 1072 is disposed on ground plane 820. In other embodiments, a gas feed connector for the gas flow element may be disposed on substrate 810. In certain other embodiments, the gas feed connector may be detached from substrate 810. The configuration of the gas feed connector will depend, at least in part, on the nature of the gas flow element being employed.

In the embodiment illustrated in FIGS. 9 and 10, plasma containment structure 1050 includes lower element 930 and an upper element 1040. Together with the first (top) surface of substrate 810, plasma containment structure 1050 forms a plasma containment enclosure which defines cavity 935 which in operation contains plasma therein. Lower element 930 of plasma containment structure 1050 includes an orifice 955 extending in a direction parallel to the plane of the first surface of substrate 810. Beneficially, orifice 955 is provided in a surface of plasma containment structure 1050 that is located furthest away from gas flow element 828.

It should be understood that plasma containment structure 1050 can be constructed in a variety of ways. For example, FIG. 11 illustrates an example where upper element 1040 comprises two separate components 1040*a* and 1040*b*. In an alternative arrangement, plasma containment structure 1050 comprises a single, unitary structure. A variety of configurations are possible. Beneficially, plasma containment structure 1050 comprises a material which is electrically insulating and which is suitable for containing a plasma (e.g., alumina or ceramic).

Electrode extensions 890 may have a variety of lengths and widths. It should be understood that in some embodiments, as the electrode extensions are lengthened the amount of plasma and light generated by the plasma generation device may be increased, at the expense of increasing the size of the plasma generation device. It should also be understood that as the size and width of the electrode extensions are changed, changes may also be made to the resonant ring, the angle θ, and/or the discharge gap so as to maintain an input impedance at the RF/microwave connector that is well-matched to the output impedance of the RF/microwave source.

An operation of plasma generation device 1000 will now be provided. In operation, a gas of a desired composition is provided from gas supply 1070 and flows through gas flow element 828. An RF/Microwave signal is provided from RF/microwave power source 1060 to microstrip resonant ring 816 which produces a strong electric field across discharge gap 818 and electrode extensions 890 and strikes the flowing gas to produce a plasma which fills cavity 935. The plasma generates a light beam 60 which exits from orifice 955 in a direction substantially parallel to the plane of the first (top) surface of substrate 810. Plasma generation device 1000 can be used in a vacuum environment while maintaining a differentially high gas pressure in the plasma region.

In one embodiment, plasma generation device 1000 is employed as a source of vacuum ultraviolet (VUV) photons exiting windowless orifice 955.

Beneficially, when an RF/microwave signal is applied to microstrip resonant ring 816, electrode extensions 890 create a linear region of a spatially-uniform electric field for striking the gas to produce the plasma. The inventors have discovered that this may circumvent the saturation phenomenon observed with respect to plasma generation device 600. The additional plasma that is generated in turn produced additional light (e.g., VUV light) at the desired wavelength.

Beneficially, plasma generation device 1000 images the light from the plasma from an "end-on" perspective via orifice 955, rather than the "top-down" perspective of plasma generation device 600. In this way, the entire linearly-extended volume of plasma due to electrode extensions 890 contributes to the overall light output produced from orifice 955.

Figure 12:
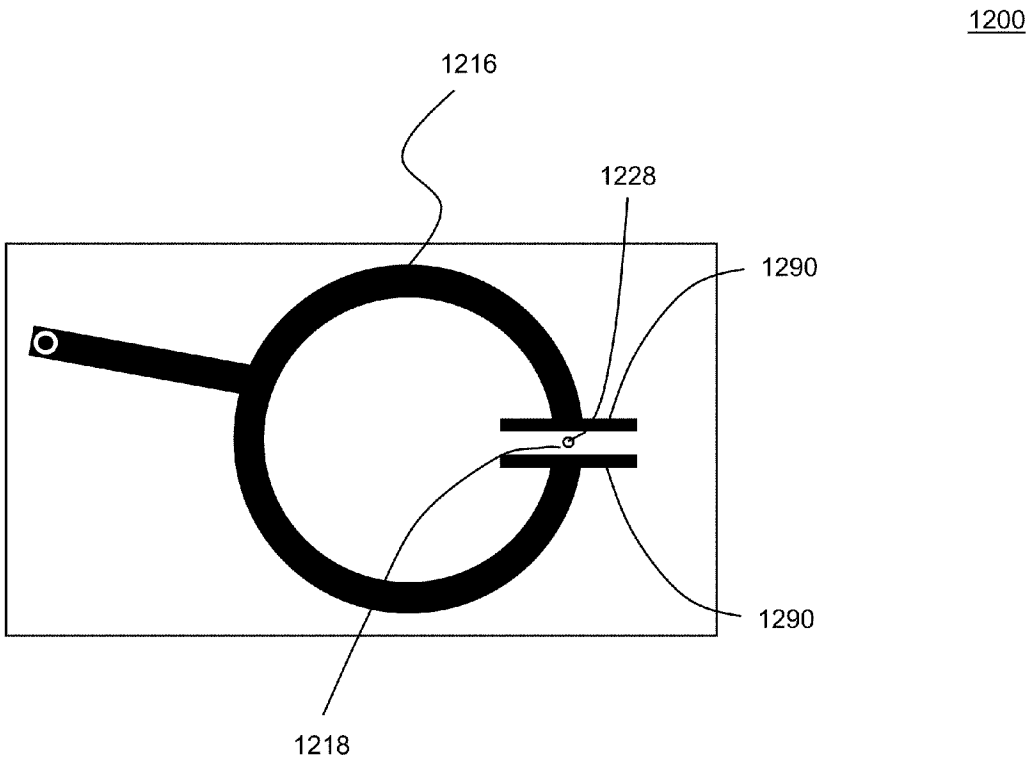
FIG. 12 illustrates another embodiment of a split-ring resonator device including electrode extensions.

FIG. 12 illustrates another embodiment of a split-ring resonator device 1200 including electrode extensions 1290. Split ring resonator device 1200 includes a gas flow element 1228 that is configured in operation (e.g., during plasma generation) to flow a stream of gas between discharge gap 1218 and/or the pair of electrode extensions. Split-ring resonator device 1200 differs from split-ring resonator device 800 as follows. In split-ring resonator device 800, electrode extensions 890 are disposed outside a perimeter of microstrip resonant ring 816. In contrast, in split-ring resonator device 1200, a portion of electrode extensions 1290 extends inside microstrip resonant ring 1216.

Figure 13:
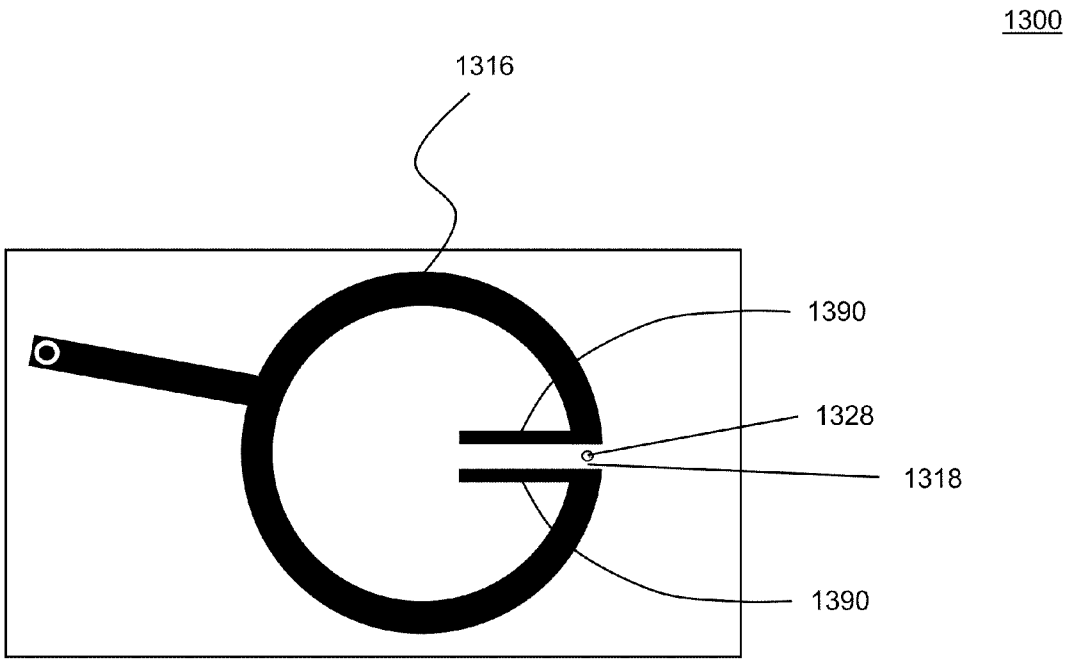
FIG. 13 illustrates still another embodiment of a split-ring resonator device including electrode extensions.

FIG. 13 illustrates still another embodiment of a split-ring resonator device 1300 including electrode extensions 1390. Split ring resonator device 1300 includes a gas flow element 1328 that is configured in operation (e.g., during plasma generation) to flow a stream of gas between discharge gap 1318 and/or the pair of electrode extensions. Split-ring resonator device 1300 differs from split-ring resonator device 800 as follows. In split-ring resonator device 800, electrode extensions 890 are disposed outside a perimeter of microstrip resonant ring 816. In contrast, in split-ring resonator device 1300, electrode extensions 1390 are disposed inside resonant ring 1316.

Plasma generation devices similar to plasma generation device 1000 can be produced using split-ring resonator devices 1200 and 1300, in place of split-ring resonator device 800.

With split-ring resonator devices 800, 1200 and 1300, electrode extensions 890, 1290, and 1390 are provided in the same plane as the corresponding microstrip resonant rings 816, 1216 and 1316. However, in general the electrode extensions do not have to be in the same plane as the resonant ring.

Figure 14:
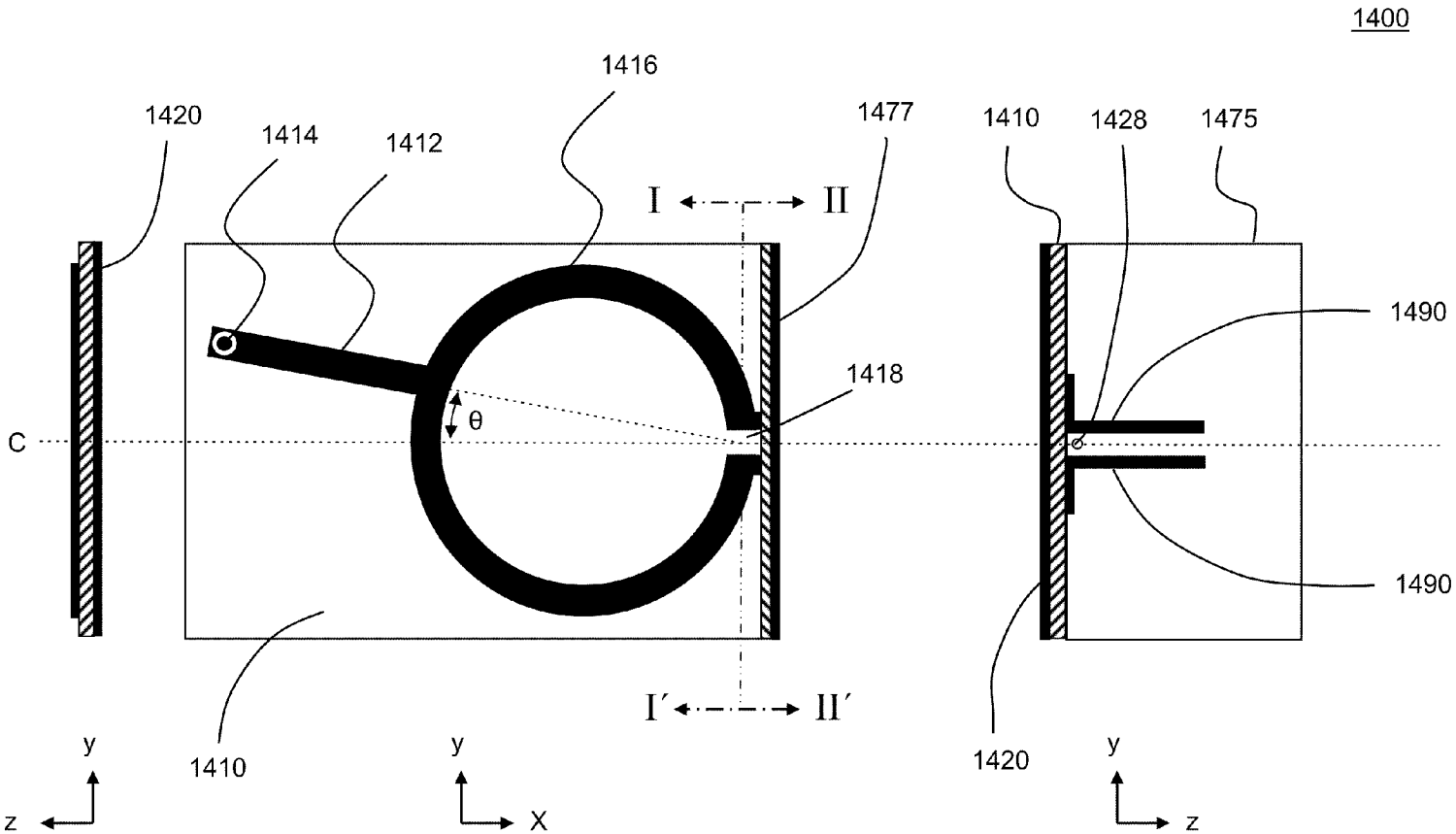
FIG. 14 illustrates yet another embodiment of a split-ring resonator device including electrode extensions.

FIG. 14 illustrates yet another embodiment of a split-ring resonator device 1400 including electrode extensions 1490 that are perpendicular to resonant ring 1416. The middle of FIG. 14 shows a top view of split-ring resonator device 1400, the left hand side of FIG. 14 shows a cross-sectional view through line I-I' in the top view of split-ring resonator device 1400, and the right hand side of FIG. 14 shows a cross-sectional view through line II-II' in the top view of split-ring resonator device 1400.

Split-ring resonator device 1400 includes a planar first substrate 1410 (planar in the X/Y plane) of dielectric material, a stripline transmission line 1412 provided on a first (top) surface of planar first substrate 1410 having a first end 1414 and at a second end that is connected to a split-ring resonator (hereinafter "resonant ring") 1416 having a discharge gap 1418. A ground plane 1420 is provided on a second (bottom) side of planar first substrate 1410, opposite the first side with the resonant ring 1416.

Split-ring resonator device 1400 further includes a second substrate 1475 disposed substantially perpendicular to planar first substrate 1410. Second substrate 1475 includes a pair of electrode extensions 1490 on a first side thereof, and ground plane 1477 on a second side thereof. Beneficially, electrode extensions 1490 are electrically connected to resonant ring 1416 at discharge gap 1418, for example by soldering.

Split-ring resonator device 1400 further includes a gas flow element 1428 that is configured in operation (e.g., during plasma generation) to flow a stream of gas between discharge gap 1418 and/or the pair of electrode extensions 1490. In the embodiment shown in FIG. 14, gas flow element 1428 is provided as an aperture extending through second substrate 1475. In an alternative arrangement, gas flow element may be provided as an aperture extending through planar first substrate 1410.

Figure 15:
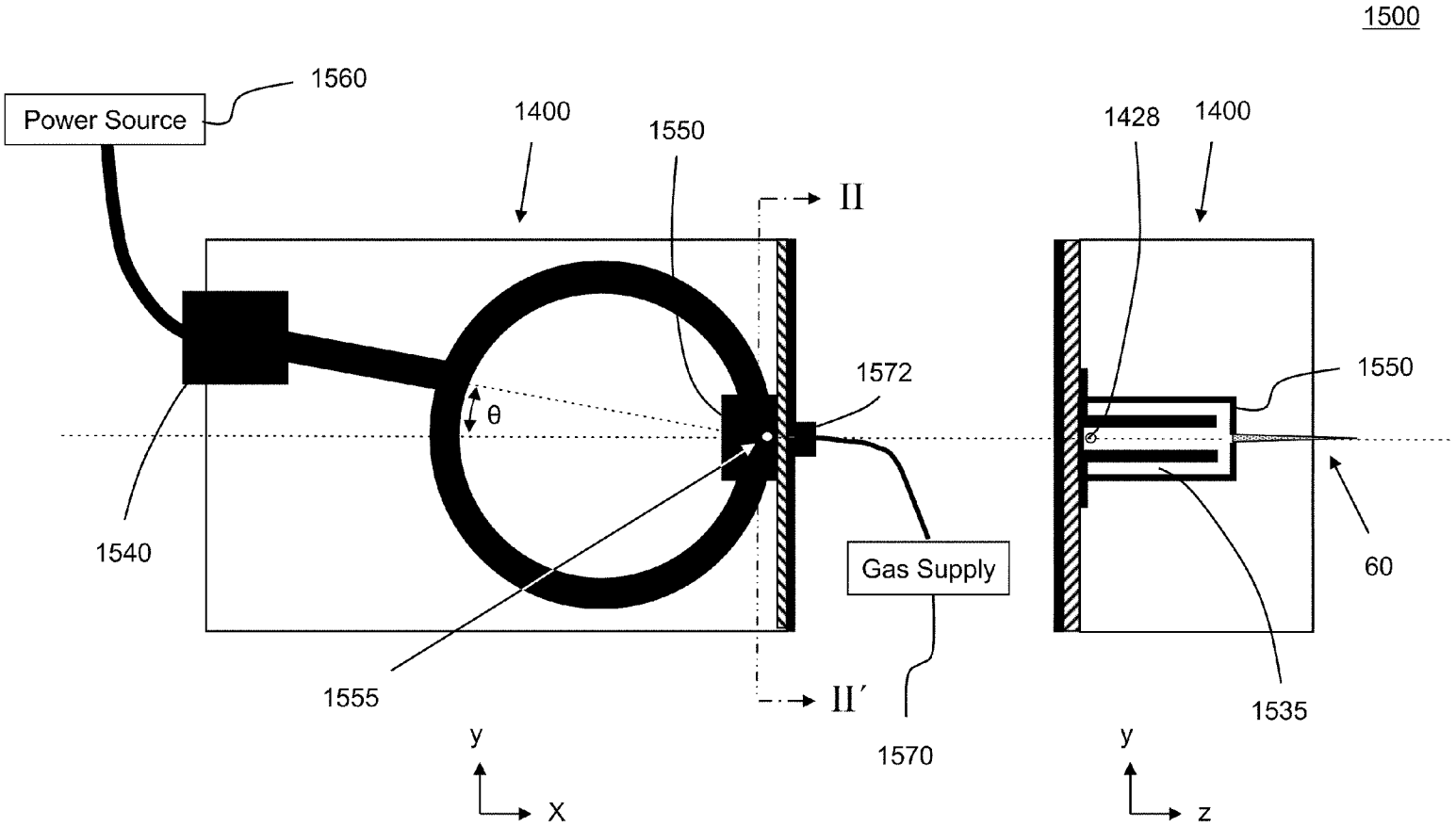
FIG. 15 illustrates one embodiment of a plasma generation device including the split-ring resonator device of FIG. 14.

FIG. 15 illustrates one embodiment of a plasma generation device 1500 including the split-ring resonator device 1400 of FIG. 14. The left hand side of FIG. 15 shows a top view of plasma generation device 1500, and the right hand side of FIG. 15 shows a cross-sectional view through line II-II' in the top view of plasma generation device 1500. Plasma generation device 1500 includes split-ring resonator device 1400, RF/microwave connector 1540, plasma containment structure 1550, RF/microwave source 1560, gas supply 1570, and a gas feed connector 1572. Plasma containment structure 1550 has an aperture therein for forming a cavity 1535. Plasma containment structure 1550 includes an orifice 1555 extending in a direction parallel to the plane of the first surface of second substrate 1475. Beneficially, orifice 1555 is provided in a surface of plasma containment structure 1550 that is located furthest away from gas flow element 1428.

Other examples of split-ring resonator devices with electrode extensions are possible. For example, electrode extensions may be provided on interior surface walls of the plasma containment structures 1050 or 1550 in the embodiments shown in FIGS. 10 and 15. Other arrangements are possible.

While example embodiments are disclosed herein, one of ordinary skill in the art appreciates that many variations that are in accordance with the present teachings are possible and remain within the scope of the appended claims. The invention therefore is not to be restricted except within the scope of the appended claims.

The invention claimed is:

1. A device, comprising:

a substrate having a first surface and a second surface;

a stripline resonant ring disposed on the first surface of the substrate, and defining a discharge gap;

a pair of electrode extensions connected to the stripline resonant ring at the discharge gap;

a ground plane disposed on the second surface of the substrate;

a gas flow element configured to flow gas between at least one of: (1) the discharge gap, and (2) the pair of electrode extensions; and a structure disposed adjacent the substrate and on an opposing side of the substrate from the gas flow element, wherein the structure forms an enclosure that substantially encloses at least a region including the discharge gap and the electrode extensions, the enclosure being adapted to contain a plasma.

2. The device of claim 1, wherein the resonant ring has a perimeter of about $\lambda/2$ at an operating frequency of the device, the stripline resonant ring having an impedance matched at the operating frequency to an impedance of a power source which provides microwave power to the resonant ring.

3. The device of claim 1, wherein the electrode extensions are disposed on the first surface of the substrate.

4. The device of claim 3, wherein the electrode extensions extend outside a perimeter of the stripline resonant ring.

5. The device of claim 3, wherein at least a portion of the electrode extensions extends inside a perimeter of the stripline resonant ring.

6. The device of claim 1, wherein the structure has orifice passing therethrough for passing light produced by the plasma to an exterior of the enclosure.

7. The device of claim 6, wherein the orifice is disposed in a surface of the structure furthest away from the gas flow element.

8. The device of claim 1, further comprising a second substrate having a first surface and a second surface, the first surface of the second substrate being arranged to be substantially perpendicular to the first surface of the first substrate, wherein the electrode extensions are provided on the first surface of the second substrate so as to lie in a plane perpendicular to a plane including the resonant ring.

9. A system, comprises:

a power source;

a gas feed line;

a plasma generation device, comprising:

(i) a substrate having a first surface and a second surface;

(ii) a stripline resonant ring disposed on the first surface of the substrate and defining a discharge gap;

(iii) a pair of electrode extensions connected to the stripline resonant ring at the discharge gap;

(iv) a ground plane disposed on the second surface of the substrate;

(v) a connector coupled to the stripline resonant ring for connecting the power source to the stripline resonant ring;

(vi) a gas flow element connected to the gas feed line and configured to flow gas between at least one of: (1) the discharge gap, and (2) the pair of electrode extensions; and (vii) structure disposed adjacent the substrate and on an opposing side of the substrate from the gas flow element, wherein the structure forms an enclosure that substantially encloses at least a region including the discharge gap and the electrode extensions, the enclosure being adapted to contain a plasma.

10. The system of claim 9, wherein the resonant ring has a perimeter of about $\lambda/2$ at an operating frequency of the device, the stripline resonant ring having an impedance matched at the operating frequency to an impedance of a power source which provides microwave power to the resonant ring.

11. The system of claim 9, wherein the electrode extensions are disposed on the first surface of the substrate.

12. The system of claim 11, wherein the electrode extensions extend outside a perimeter of the stripline resonant ring.

13. The system of claim 11, wherein at least a portion of the electrode extensions extends inside a perimeter of the stripline resonant ring.

14. The system of claim 1, wherein the structure has an orifice passing there through for passing light produced by the plasma to an exterior of the enclosure.

15. The system of claim 14, wherein the orifice is disposed in a surface of the structure furthest away from the gas flow element.

16. The system of claim 9, further comprising a second substrate having a first surface and a second surface, the first surface of the second substrate being arranged to be substantially perpendicular to the first surface of the first substrate, wherein the electrode extensions are provided on the first surface of the second substrate so as to lie in a plane perpendicular to a plane including the resonant ring.

17. A method comprises:

(a) providing a gas to a plasma generation device, the plasma generation device comprising:

(i) a substrate having a first surface and a second surface;

(ii) a stripline resonant ring disposed on the first surface of the substrate, and defining a discharge gap;

(iii) a pair of electrode extensions connected to the stripline resonant ring at the discharge gap;

(iv) a ground plane disposed on the second surface of the substrate; a pair of electrode extensions connected to the stripline resonant ring at the discharge gap;

(v) a gas flow element configured to flow gas between at least one of: (1) the discharge gap, and (2) the pair of electrode extensions; and (vi) a structure disposed adjacent the substrate and on an opposing side of the substrate from the gas flow element, wherein the structure forms an enclosure that substantially encloses at least a region including the discharge gap and the electrode extensions, the enclosure being adapted to contain a plasma;

(b) flowing the gas between at least one of: (1) the discharge gap, and (2) the pair of electrode extensions; and (c) causing an electric discharge at the discharge gap and electrode extensions sufficient to strike a plasma from the flowing gas.

18. The method of claim 17, further comprising producing a vacuum ultraviolet (VUV) light from the plasma.

19. The method of claim 18, wherein the structure includes an orifice, the method further comprising providing the VUV light from the orifice in the structure.

20. The method of claim 18, further comprising emitting the VUV light from the plasma from an orifice provided at an end of the structure furthest away from the gas flow element.

* * * * *

UNITED STATES PATENT AND TRADEMARK OFFICE

CERTIFICATE OF CORRECTION

PATENT NO. : 8,736,174 B2
APPLICATION NO. : 12/688082
DATED : May 27, 2014
INVENTOR(S) : Randall Urdahl et al.

It is certified that error appears in the above-identified patent and that said Letters Patent is hereby corrected as shown below:

In the Claims

In column 12, line 14, In Claim 9, delete "structure" and insert -- a structure --, therefor.

Signed and Sealed this
Thirty-first Day of March, 2015

Michelle K. Lee

Michelle K. Lee
*Director of the United States Patent and Trademark Office*